United States Patent [19]

Poloha

[11] Patent Number: 4,821,953

[45] Date of Patent: Apr. 18, 1989

[54] MAILBOX GRAVITY SIGNALLING APPARATUS

[76] Inventor: John Poloha, 7839 Manor Dr., West Chester, Ohio 45069

[21] Appl. No.: 250,050

[22] Filed: Sep. 28, 1988

[51] Int. Cl.[4] ..... B65D 91/00

[52] U.S. Cl. ..... 232/35; 232/34

[58] Field of Search ..... 232/17, 34, 35

[56] References Cited

U.S. PATENT DOCUMENTS

| | | | |
|---|---|---|---|
| 2,609,787 | 9/1952 | Lawson | 232/35 |
| 2,707,075 | 4/1955 | VanDuzer | 232/35 |
| 3,426,966 | 2/1969 | Lay | 232/35 |
| 3,547,070 | 12/1970 | Schuh | 116/114 |
| 4,382,541 | 5/1983 | Miller | 232/35 |
| 4,492,335 | 1/1985 | Davis | 232/35 |
| 4,708,286 | 11/1987 | Norris | 232/35 |
| 4,771,941 | 9/1988 | Bowman et al. | 232/35 |

*Primary Examiner*—Robert W. Gibson, Jr.

*Attorney, Agent, or Firm*—Henderson & Sturm

[57] ABSTRACT

A mailbox signalling apparatus (10) for use on both rural type (100) and residential type (200) mailboxes; wherein, the apparatus (10) includes a suspension unit (11) having a support arm (14) and at least one elongated slot (16); and, a signal unit (12) including a signal member (20) attached to the suspension unit (11) and provided with an attachment ring (25) that is dimensioned to be selectively received over the support arm (14) and within the slot (16).

6 Claims, 2 Drawing Sheets

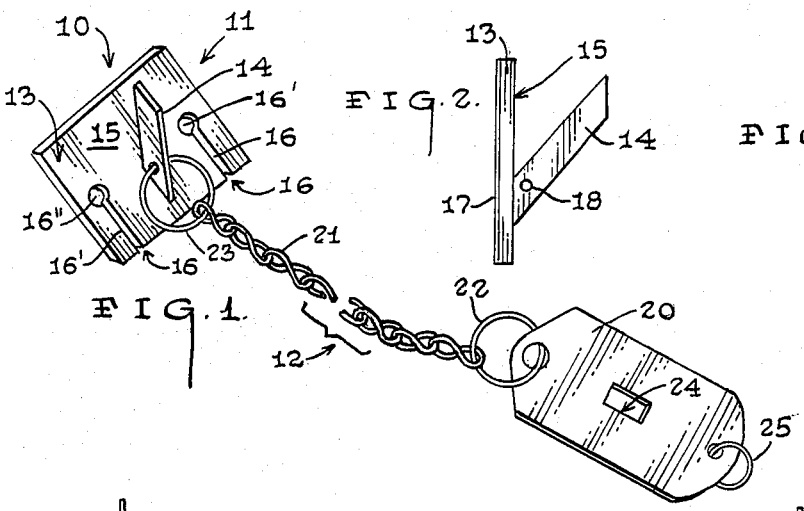
FIG. 1.
FIG. 2.
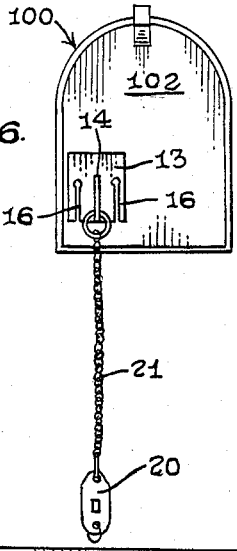
FIG. 6.
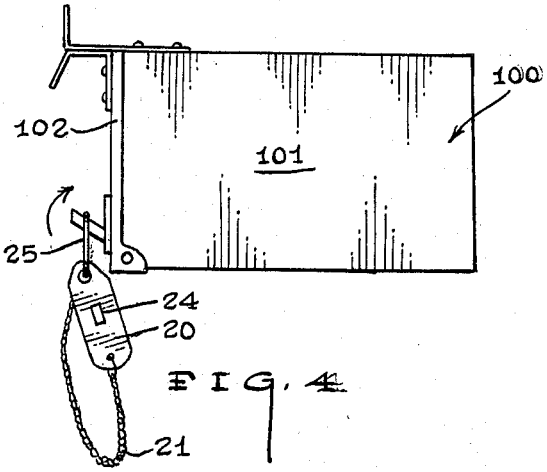
FIG. 4
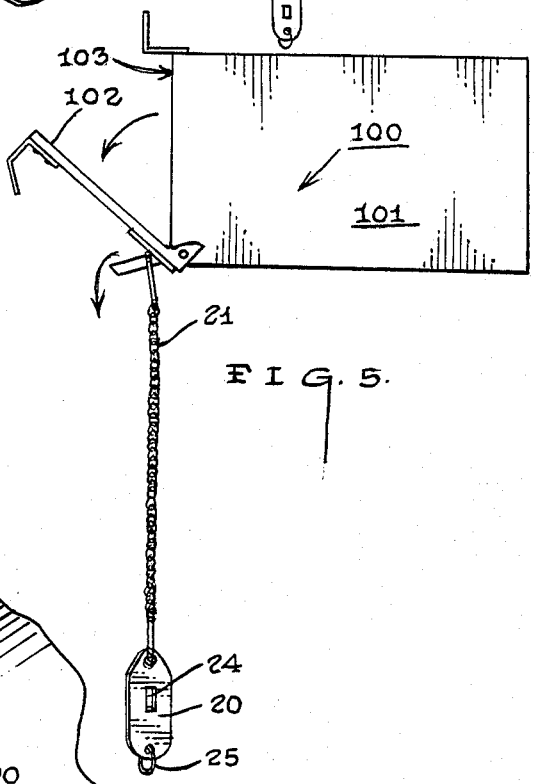
FIG. 5.
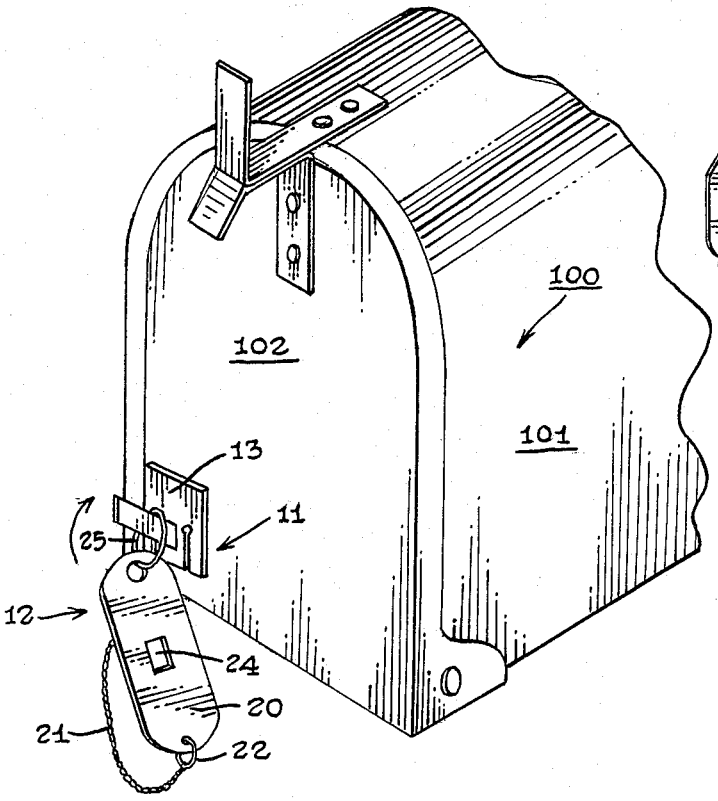
FIG. 3.

MAILBOX GRAVITY SIGNALLING APPARATUS

TECHNICAL FIELD

The present invention involves a mailbox signaling device in general, and more specifically a gravity actuated signalling device that can be employed on different types of mailboxes.

BACKGROUND OF THE INVENTION

This invention was the subject matter of Document Disclosure Program Registration No. 187,541 which was filed in the U.S. Patent and Trademark Office on Mar. 1, 1988.

As can be seen by reference to the following U.S. Pat. Nos.: 3,547,070; 4,382,541; 3,426,966 and 4,492,335 the prior art is replete with myriad and diverse mailbox signalling devices. While all of the aforementioned prior art devices are more than adequate for the basic purpose and function for which they were specifically designed, these devices are also uniformly deficient in one major respect.

This major deificiency resides in the fact that all of the prior art constructions are restricted to either a rural or a residential mailbox and are not interchangeable or adapted for use with both types of mailboxes.

Rural mailboxes for the purposes of this invention are characterized by a hinged closure that swings outwardly and downwardly relative to the mailbox opening; whereas, residentail mailboxes are characterized by a hinged lid that swings upwardly and outwardly with respect to the mailbox receptacle.

Given the reverse direction of the opening motion of the mailbox lid or closure, it is not really surprising that the prior art constructions are normally only effective with one of the two types of mailboxes.

In addition, while gravity actuated signalling devices find widespread usage in conjunction with rural type mailboxes, the prior art is virtually devoid of gravity controlled signalling devices used in conjunction with the upwardly swinging residential type mailbox.

Based on the foregoing situation is should not come as a surprise that there has existed a longstanding need among manufacturers of both mailboxes and signalling devices for the development of a signalling device that can be used interchangeably and with equal effectiveness on both the rural and the residential type of mailbox.

SUMMARY OF THE INVENTION

Briefly stated, the mailbox signalling device of the present invention comprises a rigid suspension unit and a generally flexible signal unit that is both fixedly and releasably attached to the rigid suspension unit.

The suspension unit comprises in general: a mounting plate member having an apertured support arm and a plurality of specially configured elongated recesses; wherein one portion of the signal unit may be both fixedly and releasably secured to the support arm and another portion of the signal unit may be releasably secured in either of the specially configured elongated recesses.

In addition, the mounting plate member is adapted to be secured in one operative mode of is position to a rural type mailbox and in an inverted operative mode of disposition to a residential type mailbox; wherein in the rural type mailbox situation the support arm is operatively and releasably engaged with a portion of the signal unit; and, wherein in the residentail type mailbox situation one of the specially configured elongated recesses is releasably engaged with a portion of the signal unit.

The signal unit comprises in general: a signal member suspended from a flexible chain member having one end fixedly attached to a portion of the suspension unit; wherein, the signal member is provided with a central aperture that is dimensioned to releasably receive the support arm of the suspension unit and further equipped with a ring member that can be received either by the support arm or the elongated recesses of the suspension unit to maintain the signal unit in its non-activated disposition.

As will be explained in greater detail further on in the specification, the signal unit can be suspended from the suspension unit in a variety of ways depending upon the type of mailbox on which the signalling apparatus is deployed. Then when the mailbox closure is moved to its open position to accept the insertion of mail a portion of the signalling unit will become disengaged from the suspension unit to allow the signal member to fall into its signal activated disposition.

BRIEF DESCRIPTION OF THE DRAWINGS

These and other objects, advantages, and novel features of the invention will become apparent from the detailed description of the best mode for carrying out the preferred embodiment of the invention which follows: particularly when considered in conjunction with the accompanying drawings, wherein:

FIG. 1 is an isolated perspective view of the signalling apparatus of this invention;

FIG. 2 is an isolated side plate view of the suspension unit of the invention;

FIG. 3 is a perspective view of the apparatus mounted on a rural type mailbox in the signal inactive mode;

FIG. 4 is a side plan view of the arrangement depicted in FIG. 3;

FIG. 5 is a side plan view of the apparatus mounted on a rural type mailbox in the signal active mode;

FIG. 6 is a front plane view of the arrangement depicted in FIG. 5;

BEST MODE FOR CARRYING OUT THE INVENTION

Figure 7:
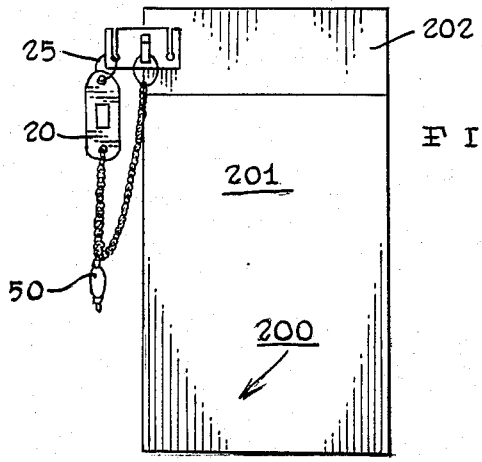
FIG. 7 is a front plan view of the apparatus mounted on a residential type mailbox in the signal inactive mode.

As can be seen by reference to the drawings and in particular to FIG. 1, the mailbox signalling apparatus that forms the basis of the present invention is designated generally by the reference numeral (10). The signalling apparatus (10) comprises in general: a suspension unit (11) and a signal unit (12). These units will now be described in seriatim fashion.

As can best be seen by reference to FIGS. 1 and 2, the suspension unit (11) comprises a generally flat rectangular suspension member (13) having a support arm (14)

disposed upwardly and outwardly at an angle with respect to the face (15) of the suspension member (13). In addition, the suspension member (13) is further provided with a pair of elongated specially contoured slots (16) which are disposed on either side of the support arm (14); and an adhesive backing (17) which is disposed on the rear surface of the suspension member (13).

As shown in FIG. 1, the elongated contoured slots (16) have an elongated stem portion (16') which terminates in an enlarged generally circular head portion (16") whose purpose and function will be explained in greater detail further on in the specification. Likewise as shown in FIG. 2, the support arm (14) is provided with a discrete aperture (18) proximate the junction of the support arm (14) and the suspension member (13); and, the purpose and function of this discrete aperture (18) will be described presently.

Turning once more to FIG. 1, it can be seen that the signal unit (12) comprises an enlarged generally flat signal member (20) which is operatively attached on one end to an elongated chain member (21) via a first attachment ring (22); wherein, a second attachment ring (23) secures the other end of the elongated chain member (21) to the support (14) by passing thru the discrete aperture (18) in a well recognized fashion.

In addition, the generally flat signal member (20) is further provided with an enlarged aperture (24) disposed proximate its mid-point and a third attachment ring (25); wherein, both the enlarged aperture (24) and the third attachment ring (25) are dimensioned to releasably engage the support arm (14) as will be explained presently.

As mentioned previously, the mailbox signalling apparatus (10) is designed to be used both in conjunction with a rural type mailbox (100) and a residential type mailbox (200). As shown in FIGS. 3 thru 6, 9 and 10, the rural type mailbox (100) comprises an elongated mailbox receptacle (101) having a vertically disposed hinged closure member (102) which swings outwardly and downwardly relative to the rural type mailbox opening (103).

Figure 8:
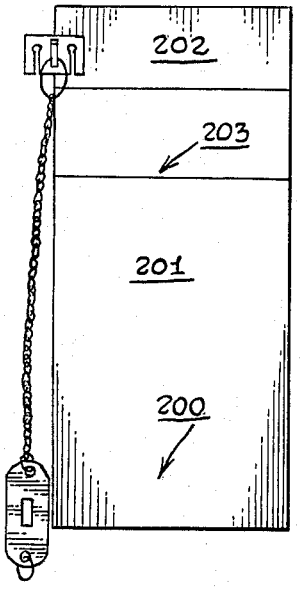
FIG. 8 is a front plan view of the apparatus mounted on a residential type mailbox in the signal active mode.

In addition, as depicted in FIGS. 7 and 8, the residential type mailbox (200) comprises an elongated mailbox receptacle (201) having an angled hinged closure member (202) which swings upwardly and outwardly with respect to the residential mailbox opening (203).

In the preferred mode of operation of the signalling apparatus (10) with respect to a rural type mailbox (100) as depicted in FIGS. 3 thru, 6, the suspension member (13) is adhesively secured to the face of the vertically disposed closure member (102) such that the free end of the support arm (14) is disposed at an upwardly directed angle. At this juncture the third attachment ring (25) on the free end of the signal member (20) is slipped over the support arm (14) to suspend the signal unit (12) in the inactive mode of disposition. Now when the hinged closure member (102) is pivoted downwardly the third attachment ring (25) will slide off the support arm (14) into the position depicted in FIGS. 5 and 6.

Figure 9:
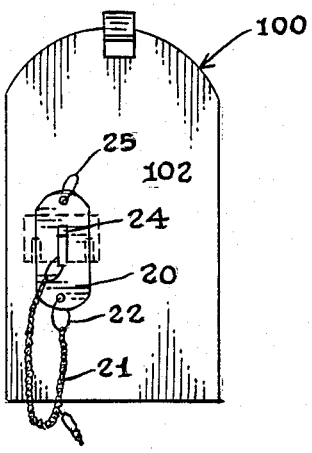
FIG. 9 is a front plan view of the apparatus in an alternate arrangement of the signal inactive mode employed with a rural type mailbox; and, FIG. 10 is a side plan view of the apparatus on a rural type mailbox in the signal active mode.
Figure 10:
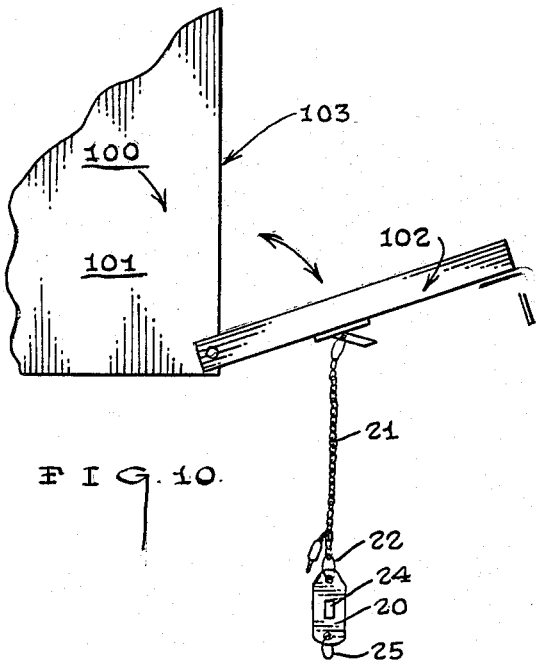

In an alternate mode of operation of the signalling apparatus (10) with respect to a rural type mailbox as depicted in FIGS. 9 and 10, the enlarged aperture (24) of the signal member (20) is slipped over the support arm (14) to suspend the signal unit (12) in the inactive mode of disposition. Then when the hinged closure member (102) is pivoted downwardly, the signal member (20) will slide off the support arm (14) into the position depicted in FIG. 10.

In the preferred mode of operation of the signalling apparatus (10) with respect to a residential type mailbox (200) the suspension member (13) is adhesively secured to the angled lid (202) of the mailbox receptacle in an inverted position such that the support arm (14) is angled downwardly relative to the hinged closure member (202); wherein, one of the elongated specially configured slots (16) on the suspension member (13) projects outwardly relative to the side of the residential mailbox receptacle (201).

In this mode of depolyment of the apparatus (10) the periphery of the third attachment ring (25) on the free end of the signal member (20) is slipped into the elongated stem portion (16') into the enlarged generally circular portion (16") of the slot (16).

In this mode of deployment of the apparatus (10) the tion (16") of the slot (16) will act as a keeper mechanism for the signal member (2); in that even in the presence of strong winds, the attachment ring (25) will tend to rotate within the generally circular portion (16") of the slot (16) rather than riding upwardly within the elongated stem portion (16'). Then when the angled hinged closure member (202) is pivoted upwardly and away from the mailbox receptacle opening (203), the attachment ring (25) will slide via gravity out of the generally circular portion (16") and down the stem portion (16') of the slot (16) to the position depicted in FIG. 8.

In closing it should also be noted that this invention also contemplates the provision of a weighted member (50) operatively associated with the elongated flexible chain member (21) to further reduce the variables of strong wind currents on the operation of the mailbox signalling apparatus (10).

Having thereby described the subject matter of this invention it should be apparent that many substitutions, modifications, and variations of the apparatus (10) are possible in light of the above teachings. It is therefore to be understood that the invention as taught and described herein is only to be limited to the extent of the breadth and scope of the appended claims.

I claim:

1. A mailbox signalling apparatus for use with mailboxes having both upwardly and outwardly swinging hinged closure members and downwardly and outwardly swinging hinged closure members wherein the apparatus comprises:

a suspension unit including a generally flat suspension member adapted to be secured to the hinged closure member of a mailbox, wherein, the suspension member is provided with a support arm that is disposed at an angle to the face of the suspension member and at least one elongated contoured slot disposed proximate the support arm; and, a signal unit operatively attached to the suspension unit and including an attachment ring that is dimensioned to be selectively received over the support arm and within the at least one elongated slot.

2. The apparatus as in claim 1 wherein the at least one elongated slot includes:

an elongated stem portion which terminates in an enlarged generally circular head portion.

3. The apparatus as in claim 1 whrein the signal unit further comprises:

an enlarged signal member operatively attached to the suspension unit by an elongated flexible member wherein the attachment ring is operatively connected to the signal member.

4. The apparatus as in claim 3 wherein the elongated flexible member comprises a chain.

5. The apparatus as in claim 3 wherein the signal member is provided with an enlarged aperture that is dimensioned to slide over the free end of the support arm on said suspension member.

6. The apparatus as in claim 1 wherein said suspension member is provided with a pair of elongated slots disposed on opposite sides of the support arm.

* * * * *